United States Patent [19]

Eubank

[11] 4,230,174

[45] Oct. 28, 1980

[54] DAMPER ASSEMBLY

[76] Inventor: Marcus P. Eubank, P.O. Box 7576, Longview, Tex. 75601

[21] Appl. No.: 953,266

[22] Filed: Oct. 20, 1978

Related U.S. Application Data

[63] Continuation of Ser. No. 778,740, Mar. 17, 1977, abandoned.

[51] Int. Cl.[3] ..... F25B 29/00

[52] U.S. Cl. ..... 165/27; 137/112; 165/31; 165/40; 165/42; 165/58

[58] Field of Search ..... 165/58, 59, 27, 31, 165/40, 42; 137/112, 533.11, 539

[56] References Cited

U.S. PATENT DOCUMENTS

| | | | |
|---|---|---|---|
| 3,851,866 | 12/1974 | Knuppet et al. | 137/112 X |
| 3,908,751 | 9/1975 | Sheppard | 165/27 |

*Primary Examiner*—Albert W. Davis
*Assistant Examiner*—Margaret A. Focarino
*Attorney, Agent, or Firm*—Wofford, Fails & Zobal

[57] ABSTRACT

An improvement in a heating and air conditioning system for a mobile home or the like including a system of air ducts for distributing the air within the mobile home, a heating unit, a cooling unit; and characterized by a plenum chamber that includes respective connected hot and cold air inlet apertures and valve seats, and at least one outlet opening connected with the air ducts; and a large hollow lightweight poppet disposed intermediate the hot and cold air valve seats. The large hollow poppet is moveable responsive to respective directions of air flow to and away from the hot and cold air valve seats so as to permit flow from one of the heating and cooling units and to block reverse flow into the other. Also provided are guide means for freely and accurately guiding the hollow poppet between its respective seating engagement positions. Also disclosed are specific embodiments, including a preferred embodiment in which the large hollow poppet is a ball whose exterior surfaces can seat at any of the relative positions against the valve seats.

5 Claims, 4 Drawing Figures

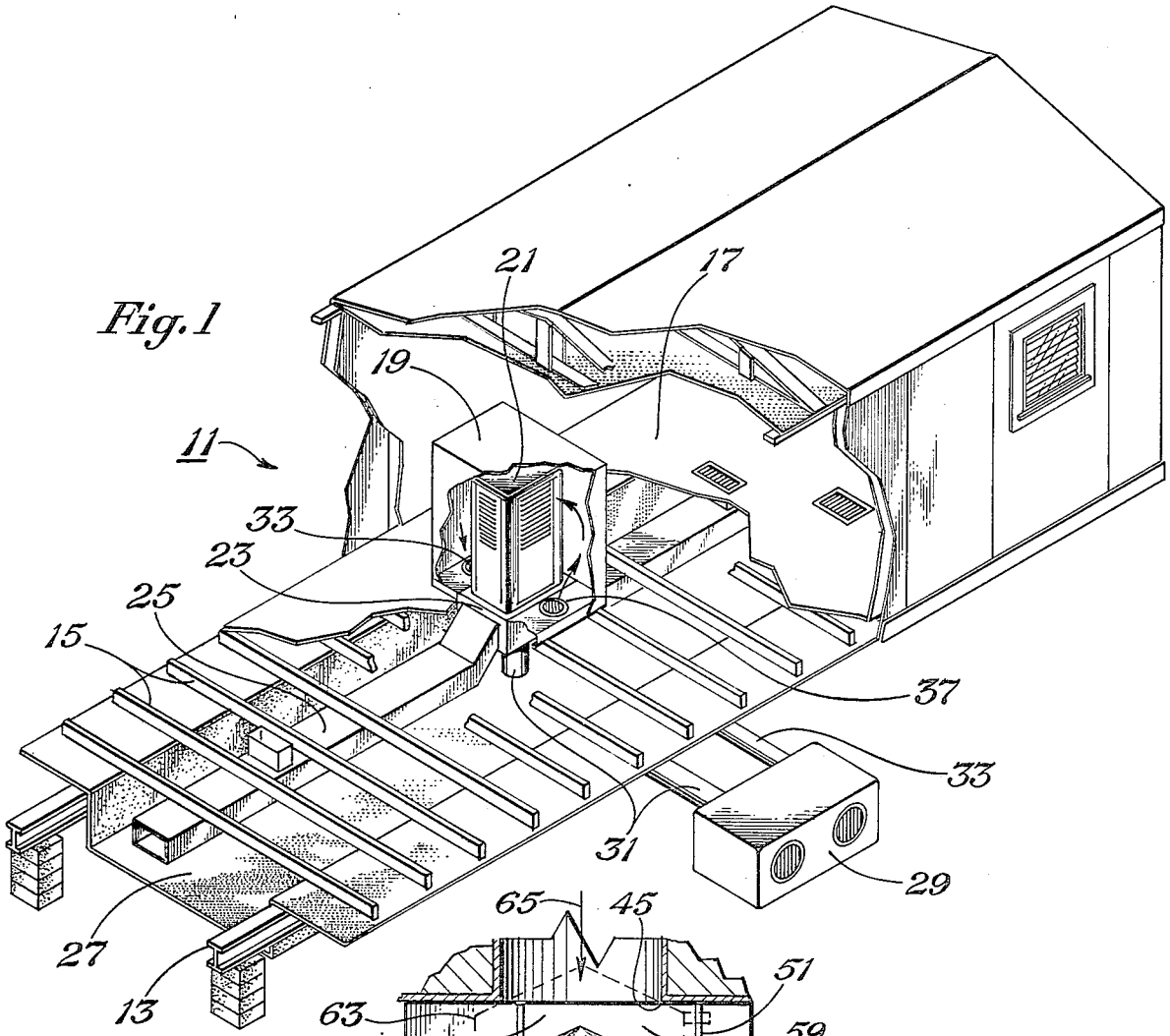
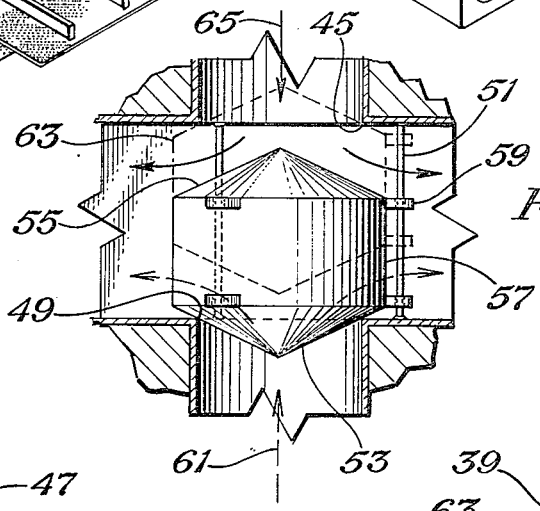
Fig.3
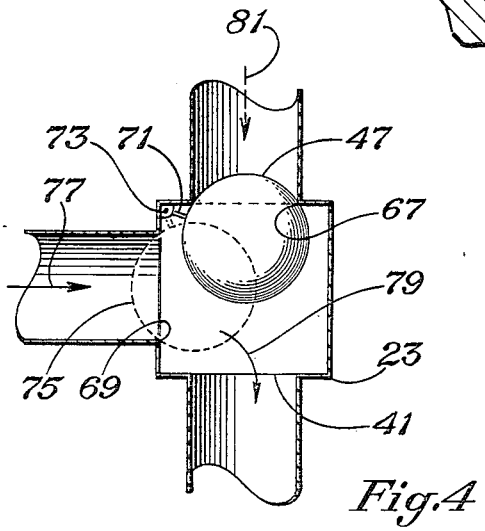
Fig.4
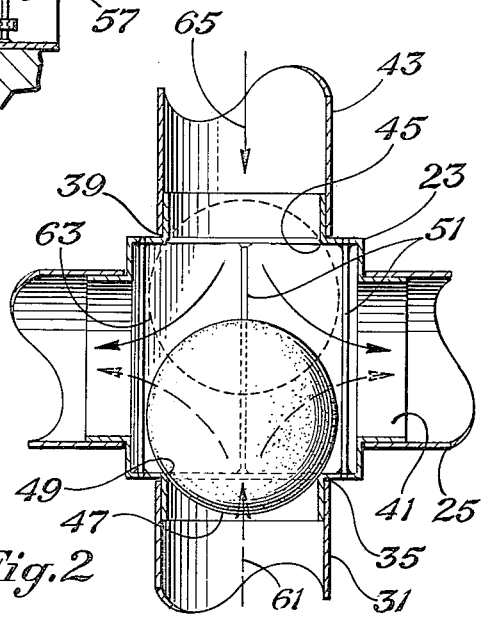
Fig.2

DAMPER ASSEMBLY

This is a continuation, of application Ser. No. 778,740, filed Mar. 17, 1977, and now abandoned.

BACKGROUND OF THE INVENTION

1. Field of the Invention

This invention relates to heating and cooling systems, such as are employed in conditioning air distributed in a mobile home or the like. More particularly, this invention relates to an improvement in the dampers and distribution system where space is at a premium and where energy conservation is vital.

2. Description of the Prior Art

In conditioning the air for circulation within certain enclosures such as mobile home, the heating and cooling units must be small and inexpensive in order to conserve space. It must be economical yet must function properly. The usual problems are exaggerated in mobile home structures since the homes inherently have less than perfect air distribution systems and magnify noise and the like. Moreover, condensation of moisture is a problem if cold air backflows through the furnace and accessories. In addition, various governmental agencies have recently issued regulations that proscribe a system that allows the backflow of air from the heating unit to a cooling unit or from a cooling unit to the heating unit. Consequently, it is necessary to provide improved damper assemblies and the like to obtain proper routing without the reverse flows that are proscribed.

The prior art has seen the development of different types of dampers. One of the most pertinent references known, that discusses this problem, is U.S. Pat. No. 3,908,751. Therein is disclosed a duct system having a butterfly valve and a plenum chamber that alternately closes the cold air inlet opening or the hot air inlet opening and deflects the moving air toward another outlet opening in the system. This improvement in the prior art served a useful purpose but was not totally satisfactory, since the butterfly valves were subject to warping with use such that they did not seal completely. Moreover, they required care in the positioning of the respective seats and seating engaging means, or portions, of the butterfly. In addition, a larger amount of energy is required to seat the large area butterfly against the relatively large seat. Specifically, a large portion of the pressure of the air stream and, hence, of the energy is wasted against a portion of the butterfly. It is hindered from freely moving because of the fixed fulcrum about which it pivots, so an inordinately large amount of energy must be expended to hold it in place; for example, closed to block the vertically oriented and upward passage of air to the heating unit.

Thus, it can been seen that the prior art has not been totally successful in solving the problem delineated hereinbefore with respect to heating and cooling systems for mobile homes and the like.

SUMMARY OF THE INVENTION

Accordingly, it is an object of this invention to provide an improved heating and cooling system that will obviate the disadvantages of the prior art and provide a distribution system and damper that has a freely moveable poppet so as to require low energy to move it into and to hold it in its respective sealing position.

It is also an object of this invention to provide, in addition to the foregoing object, an improvement in a heating and cooling system for a mobile home and the like in which the damper assembly seats readily and positively against a seat that is no larger than the duct or opening from the respective heating and cooling units and employs a lightweight, freely moveable poppit that readily moves responsive to directional air flow.

These and other objects will become apparent from the descriptive matter herein, particularly when taken in conjunction with the appended drawings.

In accordance with this invention, there is provided an improvement in a heating and cooling system for a mobile home or the like, including a system of air ducts for distributing the air within the mobile home, a heating unit, including a hot air exhaust; and a cooling unit, including a cold air exhaust and an improvement characterized by the following. The improvement comprises a plenum chamber that includes a hot air inlet aperture in a first wall portion and connected in communication with the hot air exhaust of the heating unit; a cold air inlet aperture in a second wall portion disposed in predetermined relationship to the first wall portion and connected in communication with the cold air exhaust of the cooling unit; and one or more outlet openings in other side walls connected in communication with the system of air distribution ducts. The improvement also includes respective smooth, circular hot and cold air valve seats disposed in their predetermined positions in fluid tight relationships with their respective hot and cold air inlets; a large hollow, lightweight poppet disposed intermediate the hot and cold air valve seats and having respective smooth, circular seat engaging means for sealingly fitting respective hot and cold air valve seats. The large hollow poppet is moveable responsive to the directional air flow to and away from the hot and cold air valve seats so as to place at any respective flow of air only one of seat engaging means sealingly against only one of the hot and cold air valve seats, to allow flow from the other and opposite of the cold and hot air valve seats and to block reverse flow through the one of the hot and cold air valve seats. Guide means are provided for freely guiding the hollow poppet between the respective positions sealingly engaging the respective hot and cold air valve seats for insuring proper and sealing seating between the respective seats and the seat engaging means.

BRIEF DESCRIPTION OF THE DRAWINGS

FIG. 1 is a schematic illustration of a portion of a mobile home, showing the heating unit, the cooling unit, and the system of air ducts as related to a typical structure.

FIG. 2 is a side elevational view, partly in section, of a plenum and damper assembly of one embodiment of this invention, for use as illustrated in FIG. 1.

FIG. 3 is a partial side elevational view, partly in section, of another embodiment of this invention.

FIG. 4 is a top plan view, partly in section, of a plenum and damper assembly of still another embodiment of this invention.

DESCRIPTION OF THE PREFERRED EMBODIMENTS

Referring to FIG. 1, mobile home 11 includes a pair of parallel, horizontal support beams 13 to which are attached wheels (not shown). Joists 15 extend across the support beams 13. A floor, or subfloor, 17 covers the joists. Conventional studding and interior and exterior portions of walls, electrical system and other components are constructed as usual.

As illustrated, a heating unit closet 19 is disposed within the home and encloses a heating unit, or furnace, 21. The heating unit has a hot air exhaust. A plenum chamber 23 is located beneath the heating unit 21. A system of air ducts 25 extend along the length of the mobile home, beneath the joists 15 and between parallel support beams 13. Suitable insulation may be employed, about the respective ducts or about a basement chamber 27, defined between the beams 13. The basement chamber 27 is closed at its ends and has respective vents, or registers, in the respective rooms and at the furnace closet 19.

A cooling unit 29 may comprise one or two piece units with respective condensers and evaporators together or separate. As illustrated, the cooling unit 29 is an integral unit and has the evaporator in the same cabinet with the condenser and has respective cold air supply duct 31 and return air duct 33 for circulating cool air within the mobile home. The cold air supply duct 31 is connected to the cold air exhaust of the air cooling unit 29 and passes upwardly through the bottom of the basement chamber 27 and into fluid tight communication with the plenum chamber 23 on its bottom wall. At the bottom wall, it is connected with the cold air inlet aperture 35, illustrated more clearly in FIG. 2. The respective ends of the return air duct 33 are connected in communication with the air cooling unit 29 such that the air is cooled when passed over the evaporator thereof; and with the interior of the closet 19. As illustrated, all of the air that is returned, or circulated back, passes from the chamber 27 upwardly through aperture 37 into the interior of the closet 19, regardless of whether it is heated or cooled. This arrangement is not vital, since with the improved damper assembly of this invention, whichever unit, the heating unit or the cooling unit, is operating can take suction directly from the chamber 27 if desired.

Referring to FIG. 2, plenum chamber 23 includes a hot air inlet aperture 39, the cold air inlet aperture 35 and at least one outlet opening 41 in side walls.

The hot air inlet aperture 39 is disposed in a first wall portion, such as the top wall portion and connected in communication with the hot air exhaust of the heating unit, as by duct 43.

The cold air inlet aperture 35 is disposed in a second wall portion that is in a predetermined relationship with the first wall portion. Specifically, as illustrated, the second wall portion is opposite to the first wall portion, or located on the bottom. The cold air inlet aperture 35 is connected in communication with the cold air exhaust of the cooling units as by the cold air supply duct 31.

There is at least one outlet opening 41 in the side wall portions. As illustrated, there are two outlet openings 41 connected in communication with the system of air ducts; namely, the ducts 25, running fore and aft in the mobile home and extending to the respective rooms therewithin for circulating the air.

A smooth circular hot air valve seat 45 is disposed in fluid tight relationship with the hot air inlet. As illustrated, the seat 45 is formed by simply forming a smooth arcuate seat to conformingly receive in sealing relationship a ball damper, such as the ball 47.

Similarly, a smooth circular cold air valve seat 49 is disposed in fluid tight relationship with the cold air inlet 35. The cold air valve seat 49, similarly as the hot air valve seat 45, is formed by smoothing a seating surface to conformingly and sealingly receive the ball 47 that is blown thereagainst by an oppositely directed air stream.

The ball 47 is a preferred embodiment of a large hollow, lightweight poppet that is disposed intermediate the hot and cold air valve seats for sealingly engaging only one of them to prevent the reverse flow into the non-operating heating or cooling unit. Specifically, the large hollow, lightweight poppet has smooth circular seat engaging means for sealingly fitting the respective hot and cold air valve seats. One of the advantages of employing a ball 47 is that its entire outer surface can be smooth to fit the respective seats and obviate difficulties with alignment of the respective seats and seat engaging means.

In any event, the large hollow, lightweight poppet is moveable responsive to a respective direction of air flow to and away from the hot and cold air valve seats so as to place only one of the seat engaging means sealingly against only one of the hot and cold air valve seats to permit flow from the other and opposite of the cold and hot air valve seats and to block reverse flow through the one against which it seals.

Suitable guide means, such as rods 51, are provided for freely guiding the hollow poppet between the first and second positions equivalent to the sealing engagement of the respective seating means with the hot and cold air valve seats for insuring proper and sealing seating of the respective seats against the seat engaging means.

In operation, the respective system is connected as described hereinbefore with the ball 47 disposed within the plenum chamber 23. When the heating unit 21 is off and the cooling unit 29 is energized, cold air flows through the cold air supply duct 31. The upward flow of air causes the ball 47 to move upwardly to engage the hot air valve seat 45 and prevent backflow of cold air into the heating unit. This is in accord with statutory regulations and with preventing condensation, rust and the like within the heating unit during the season when the cooling unit 29 is operating.

Since the entire air stream is directed against the freely moveable ball, very little energy is required to keep the ball seated sealingly against the hot air valve seat 45 and divert the air through the respective openings 41 and the air distribution conduits 25.

Conversely, when the cooling unit 29 is off and the heating unit 23 is on, the ball 47 moves to sealingly seat against the cold air valve seat 49 and divert the hot air through the openings 41 and the ducts 25, preventing backflow of hot air into the cooling unit 29.

As is readily understood, return air passes downwardly through the respective return air registers and into the basement chamber 27 and then back to the closet 19. The return air is then sucked into the heating unit for distribution, if on the heating cycle, or into the cooling unit 29 for distribution if on the cooling cycle.

A double wide mobile home or plurality of sections of a sectional home may be employed and employ the same principle as described hereinbefore with one or more duct distribution systems and plenum chambers 23 with respective large hollow lightweight poppets, such as ball 47, for seating against the respective seats.

Other Embodiments

While the preferred embodiment has been described hereinbefore, there are a plurality of other embodiments that are engineeringly feasible for use of this invention. For example, FIG. 3 illustrates an embodiment in which a different large hollow, lightweight poppet is employed. Therein, the respective hot air valve seat 45 and the cold air valve seat 49 are connected and employed in conjunction with the respective inlet apertures and outlet openings, respective heating and cooling units, and air distribution ducts, all as described with respect to FIG. 2. The large hollow, lightweight poppet is characterized by oppositely disposed frusto-conical surfaces 53 and 55. As illustrated, the frusto-conical surfaces are, in fact, cones themselves, although the respective apices are not necessary to insure proper seating and their omission will shorten the distance required for full traverse of the extremities of the poppet. The frusto-conical sections are held in predetermined relationship spaced from each other by a cylindrical tubular section 57. With the oppositely disposed frusto-conical sections, greater care is necessary to effect alignment than with the ball 47. Consequently, in addition to the guide rods 51, aligning brackets 59 are employed. The aligning brackets are fixedly attached to the poppet and are slideable longitudinally of the guide rods 51.

In operation, the poppet moves responsive to the respective direction of air flow, similarly as described with respect to the ball 47. Specifically, as cold air flows upwardly, as indicated by the dashed line arrow 61, in FIGS. 2 and 3, the poppet moves upwardly to the top positions, shown by dashed lines 63, FIGS. 2 and 3. Conversely, as the hot air is directed downwardly, as indicated by the arrows 65, FIGS. 2 and 3, the poppet is moved downwardly to seat against the hot air valve seat 49, as shown in solid lines. Consequently, as described hereinbefore, the respective hot and cold air streams are directed into the distribution ducts and circulated through the mobile home for the proper conditioning.

If desired, the hot and cold air valve seats need not be oppositely disposed. For example, as illustrated in FIG. 4, the ball 47 may seat respectively against a first air valve seat 67 or against a second air valve seat 69 that are disposed in any predetermined relationship, such as 90° with respect to each other. In such an event, the guide means may comprise a suitable pivotally mounted guide arm 71 that moves pivotally about a fulcrum axis 73 to swing the ball into the respective sealing positions, as illustrated in respective solid and dashed lines 47 and 75, FIG. 4. Thus, in operation, a first air stream is flowed, as indicated by arrow 77, in a first direction into the plenum chamber 23. Responsive to the air flow, the ball 47 is moved against the first air valve seat 67 to block flow through the first air valve seat 67 and the attached conduit, or duct. This relationship is effective whether the plenum chamber 23 is mounted in a vertical position, as described hereinbefore with respect to FIGS. 2 and 3, or in a horizontal plane, as illustrated, that is at 90° to the relationship of FIGS. 2 and 3. Thus, the respective first air stream is diverted outwardly through the outlet opening 41 and its associated conduit, as indicated by arrow 79.

On the other hand, when a second air stream is directed, as indicated by dashed arrow 81, the ball 47 is moved into sealing relationship with the second air valve seat 69. This position is indicated in dashed lines 75. Thus, air is directed outward through the outlet opening 41 and reverse flow through the second air valve seat 69 is prevented.

The poppet is hollow with a thin, lightweight skin thereabout. The skin must have sufficient rigidity to support the seat engaging means so as to sealingly engage the seats. The poppet, regardless of the shape that it takes, may be formed of any material that has the sufficient lightweight and structural strength and rigidity to perform the functions delineated herein and to be resistant to hot and cold air flowing from the respective heating and cooling units. Metals, such as aluminum and magnesium, have been found satisfactory for this purpose. Corrosion resistant iron alloys, such as stainless steel, can also be employed, although they are more expensive. The tough, non-warping plastics, such as polymers and copolymers of the ethylene—and propylene—fluorocarbons, such as Teflon and Teflon-100, Nylon, Delrin, polypropylene, polyvinylchloride and acrylonitrile butadiene styrene copolymer (ABS) can be employed. Even the thermosetting copolymers such as the phenolformaldehyde copolymers can be employed if their propensity to warp is carefully overcome by heating to relieve stresses during the pressure forming thereof.

The guide means may comprise guide rods, hinge mounting or any suitable means to effect seating of the poppet. For example, the guide means may comprise having walls and seats arranged and spaced such that the poppet is free-floating but constrained between the seats without escaping, as by clearance between the seats less than the diameter of a ball poppet. With such an arrangement, the damper will always seat and block undesired flow.

From the foregoing it can be seen that this invention accomplishes the objects delineated hereinbefore and provides an unusually effective damper assembly that can be employed in combination with heating and cooling units in an air distribution system for a mobile home or the like that is effective in sealing with very little energy expended to move it into its respective sealing positions and to hold it there.

Although the invention has been described with a certain degree of particularity, it is understood that the present disclosure is made only by way of example and that numerous changes in the details of construction and the combination and arrangement of parts may be resorted to without departing from the spirit and scope of this invention which is defined by the appended claims.

What is claimed is:

1. In a heating and cooling system for a mobile home and the like, including a system of air ducts extending about the mobile home and communicating with the mobile home interior, a heating unit in the mobile home and including a hot air exhaust, a cooling unit in the mobile home and including a cold air exhaust; the improvement comprising:

a. a plenum chamber including:
   i. a hot air inlet aperture in a first wall portion and connected in communication with said hot air exhaust of said heating unit;
   ii. a cold air inlet aperture in a second wall portion opposite the said first wall portion and connected in communication with said cold air exhaust of said cooling unit; and
   iii. outlet openings in side wall portions and connected in communication with the system of air ducts;

b. a smooth circular hot air valve seat disposed in fluid tight relationship with said hot air inlet;

c. a smooth circular cold air valve seat disposed in fluid tight relationship with said cold air inlet;

d. a large hollow, lightweight poppet disposed intermediate said hot and cold air valve seats and having respective smooth circular seat engaging means for sealingly fitting respective said hot and cold air valve seats, said large hollow poppet being moveable responsive to respective directions of air flow to and away from said hot and cold air valve seats so as to place at any respective flow of air only one of said seat engaging means sealingly against only one of said hot and cold air valve seats to permit flow from the other and opposite of said cold and hot air valve seats and to block reverse flow through said one of said hot and cold air valve seats; and e. guide means for freely guiding said hollow poppet between said hot and cold air seats for insuring properly and sealing seating of the respective seats and seat engaging means.

2. In a heating and cooling system for a mobile home and the like, including a system of air ducts extending about the mobile home and communicating with the mobile home interior, a heating unit in the mobile home and including a hot air exhaust from the unit, a cooling unit for the mobile home and including a cold air exhaust from the cooling unit; the improvement comprising:

a. a plenum chamber including:

i. a hot air inlet aperture in a first wall portion and connected in communication with said hot air exhaust of said heating unit;

ii. a cold air inlet aperture in a second wall portion opposite said first wall portion and connected in communication with said cold air exhaust of said cooling unit; and iii. outlet openings in said wall portions and connected in communication with the system of air ducts;

b. a smooth circular hot air valve seat disposed in fluid tight relationship with said hot air inlet;

c. a smooth circular cold air valve seat disposed in fluid tight relationship with said cold air inlet;

d. a large hollow, lightweight poppet disposed intermediate said hot and cold air valve seats; said large hollow lightweight poppet comprising a large ball that is hollow and has a lightweight skin so as to be readily moved by airflow thereagainst, the exterior surface of which is smooth and circular so that any part of the entire surface can sealingly seat against the respective valve seats; said hollow ball being moveable in response to the flow of cold air from the cooling unit through the cold air inlet aperture to a first position away from the cold air valve seat to sealingly fit its exterior surface against said hot air valve seat and block flow of said cold air to the heating unit and divert said cold air into said air ducts, and being moveable in response to the flow of hot air from the heating unit through the hot air inlet aperture to a second position away from the hot air valve seat to sealingly fit its exterior surface against said cold air valve seat and block flow of said hot air to said cooling unit and divert said hot air into said air ducts; and e. guide means for freely guiding said hollow poppet between said hot and cold air seats for insuring proper and sealing seating of the respective seats and exterior surface of said ball.

3. The heating and cooling system of claim 1 wherein said large hollow lightweight poppet has frusto-conical surfaces at oppositely disposed ends and said guide means serve to keep said poppet oriented such that said frusto-conical surfaces face the respective valve seats against which they will seat responsive to directional flow of air from the opposite direction.

4. In a heating and cooling system for an enclosure including a system of air ducts extending and in communication with the interior of said enclosure, an air conditioning means for respectively heating and cooling air to circulated in said enclosure and including a first air exhaust and a second air exhaust; the improvement comprising:

a. a plenum chamber including:

i. a first air inlet aperture in a first wall portion and connected in communication with said first air exhaust of said air conditioning means;

ii. a second air inlet aperture in a wall portion disposed in predetermined relationship to said first wall portion and connected in communication with said second air exhaust of said air conditioning means; and iii. at least one outlet opening in a third wall portion and connected in communication with the system of air ducts;

b. smooth circular first air valve seat disposed in fluid tight relationship with said first air inlet;

c. smooth circular second air valve seat disposed in fluid tight relationship with said second air inlet;

d. large hollow lightweight poppet disposed intermediate said first and second air valve seats, having respective smooth circular seat engaging means for sealingly fitting respective said first and second air valve seats, and moveable responsive to respective directions of air flow to and away from said first and second air valve seats so as to place at any respective flow of air only one of said seat engaging means sealingly against only one of said first and second air valve seats to permit flow from the other and opposite of said second and first air valve seats and to block reverse flow through said one of said first and second air valve seats; and e. guide means for freely guiding said hollow poppet between respective first and second positions with said only one seat engaging means sealingly placed against only one of said first and second air valve seats; said guide means insuring proper and sealing seating of the respective seats and seat engaging means.

5. The heating and cooling system of claim 4 wherein said large hollow lightweight poppet comprises a large hollow ball with outer surfaces that will sealingly engage the respective first and second valve seats when swung thereagainst by a respective opposite flow of air.

* * * * *